US006262532B1

(12) United States Patent
Park et al.

(10) Patent No.: US 6,262,532 B1
(45) Date of Patent: Jul. 17, 2001

(54) PLASMA DISPLAY DEVICE WITH ELECTRICALLY FLOATED AUXILIARY ELECTRODES

(75) Inventors: Deuk-il Park, Cheonan; Jong-seo Choi; Kyu-nam Joo, both of Suwon, all of (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/281,435

(22) Filed: Mar. 30, 1999

(30) Foreign Application Priority Data

Mar. 31, 1998 (KR) ..... 98-11338

(51) Int. Cl.[7] ..... H01J 17/49
(52) U.S. Cl. ..... 313/585; 313/492; 315/169.4
(58) Field of Search ..... 313/585, 586, 313/491, 587, 492; 315/169.4

(56) References Cited

U.S. PATENT DOCUMENTS 4,638,218 * 1/1987 Shinoda et al. ..... 315/169.4
4,737,687 * 4/1988 Shinoda et al. ..... 315/169.4
5,952,782 * 9/1999 Nanto et al. ..... 313/586
6,043,605 * 3/2000 Park ..... 313/586

FOREIGN PATENT DOCUMENTS 0135382 3/1985 (EP) ..... H01J/17/49
2129595 5/1984 (GB) ..... H01J/17/49
56149748 11/1981 (JP) ..... H01J/11/02
5767262 4/1982 (JP) ..... H01J/17/49
57103234 6/1982 (JP) ..... H01J/11/02

* cited by examiner

*Primary Examiner*—Michael H. Day
(74) *Attorney, Agent, or Firm*—Leydig, Voit & Mayer, Ltd.

(57) ABSTRACT

A plasma display device includes a rear substrate (21); first electrodes (22) on an upper surface of the rear substrate (21) in a pattern; second and third electrodes (24, 25) spaced from the first electrodes (22) by a distance, parallel to each other and perpendicular to the direction of the first electrodes (22); auxiliary electrodes (26), parallel to each other and between the second and third electrodes (24, 25), which are electrically floated; a dielectric layer (23) on the upper surface of the rear substrate (21) covering the first electrodes (22), and in which the second electrodes (24), the third electrodes (25), and the auxiliary electrodes (26) are embedded and electrically insulated from one another; and a front substrate (30) supported by the rear substrate (21) and defining a discharge space.

8 Claims, 4 Drawing Sheets

PLASMA DISPLAY DEVICE WITH ELECTRICALLY FLOATED AUXILIARY ELECTRODES

BACKGROUND OF THE INVENTION

1. Field of the Invention

The present invention relates to a plasma display device using a surface discharge.

2. Description of the Related Art

A plasma display device having a large display capacity and exhibiting superior brightness, contrast, and viewing angle characteristics is widely noted as a flat panel display which can replace the cathode ray tube. The plasma display devices are divided into a direct current plasma display devices and an alternating current plasma display devices according to operating principles. In the direct-current plasma display device, all electrodes are exposed to a discharge space and charges move directly between the corresponding electrodes. Contrarily, in the alternating current plasma display device, at least one electrode among the corresponding electrodes is surrounded by a dielectric material and discharge occurs due to an electrical field of wall-charges.

FIGS. 1 and 2 show an example of a surface-discharge type plasma display device. Referring to the drawings, the plasma display device includes a rear substrate 10, first electrodes 11 formed on the rear substrate 10 in a predetermined pattern, a dielectric layer 12 coating on the first electrodes 11 and the rear substrate 10, a partition 13 on the dielectric layer 12, defining a discharge space and preventing electrical and optical crosstalk between neighboring discharge cells, and a front substrate 16 coupled to the partition 13, on the lower surface of which second and third electrodes 14 and 15 having a predetermined pattern perpendicular to the direction of the first electrode 11 are formed.

A dielectric layer 18 is formed on the lower surface of the front substrate 16 such that the electrodes 14 and 15 are embedded. A protective layer 19 can further be formed on the lower surface of the dielectric layer 18. A fluorescent layer 17 is formed at least one side of the discharge space defined by the partition 13. The discharge space is filled with a discharge gas.

In the plasma display device having the above structure, when a voltage is applied to the first electrode 11 and the second electrode 15, a common electrode, a preliminary discharge is generated between the first and second electrodes 11 and 15 and charged particles are formed on the lower surface of the dielectric layer 18 of the front substrate 16. In this state, as a predetermined voltage is applied between the second electrode 14 and the third electrode 15, a maintenance discharge is generated on the surface of the dielectric layer 18 of the front substrate 16. As a plasma is formed in a gas layer, ultraviolet light is emitted therefrom. The ultraviolet light excites fluorescent material of the fluorescent layer 17 and thus an image is formed.

However, the conventional plasma display device operating as above has problems as follows.

First, since the distance between the first and second electrodes is relatively wide, a high voltage, such as 300V, must be applied between the first and second electrodes to perform a preliminary discharge. This becomes the major cause of reduction in the life of a display panel.

Second, since the second and third electrodes are in the same plane, electrostatic capacitance between said second and third electrodes is relatively low and thus a plasma of weak energy is formed. Therefore, the brightness of an image deteriorates.

Third, since the second and third electrodes and the dielectric layer are formed on the front substrate, these electrodes should be formed of a transparent material. This not only limits the choice of materials for an electrode but also lowers the optical transmissivity of the front substrate.

And fourth, since the distance between the second and third electrodes is relatively narrow, in the maintenance discharge, the formation area of plasma is not wide so that the fluorescent material cannot be sufficiently excited.

SUMMARY OF THE INVENTION

To solve the above problems, it is an objective of the present invention to provide a plasma display device in which the optical transmissivity of the front substrate is improved by forming the second and third electrodes on the rear substrate, a low voltage is available for initial discharge, and strong ultraviolet light for exciting fluorescent material can be obtained.

Accordingly, to achieve the above objective, there is provided a plasma display device which comprises: a rear substrate; first electrodes formed on the upper surface of the rear substrate in a predetermined pattern; second and third electrodes formed above the first electrodes being separated by a predetermined distance and parallel to each other and perpendicular to the direction of the first electrodes; auxiliary electrodes disposed parallel to each other between the second and third electrodes which are near each other to be electrically floated; a dielectric layer formed on the upper surface of the rear substrate in which the first electrodes, the second electrodes, the third electrodes, and the auxiliary electrodes are embedded and electrically insulated from one another; and a front substrate coupled to the upper portion of the rear substrate to define a discharge space.

It is preferable in the present invention that the dielectric layer comprises: a first dielectric layer in which the first electrodes are embedded; and a second dielectric layer in which the second electrodes, the third electrodes, and the auxiliary electrodes are embedded.

Also, it is preferable in the present invention that each of the auxiliary electrodes is discontinuously formed to have a predetermined width and length.

Further, it is preferable in the present invention that the thickness of the dielectric layer between the first electrode and the second electrode is greater than that of the dielectric layer between the first electrode and the auxiliary electrode, and that a protruding portion is formed on the first electrodes at each position facing the auxiliary electrode.

According to another aspect of the present invention, there is provided a plasma display device which comprises: a rear substrate; first electrodes formed on the rear substrate in strips and parallel to each other; second and third electrodes formed above the first electrodes being separated by a predetermined distance and parallel to each other and perpendicular to the direction of the first electrodes; auxiliary electrodes disposed parallel to each other between the second electrode and the third electrode which are near each other to be electrically floated; a dielectric layer formed on the upper surface of the rear substrate in which the first electrodes, the second electrodes, the third electrodes, and the auxiliary electrodes are embedded and electrically insulated from one another; partitions formed on the upper surface of the dielectric layer and between the neighboring first electrodes, parallel to the first electrodes; a transparent front substrate coupled to the rear substrate to define a discharge space along with the partitions; and a fluorescent layer formed on the lower surface of the front substrate inside the discharge space.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
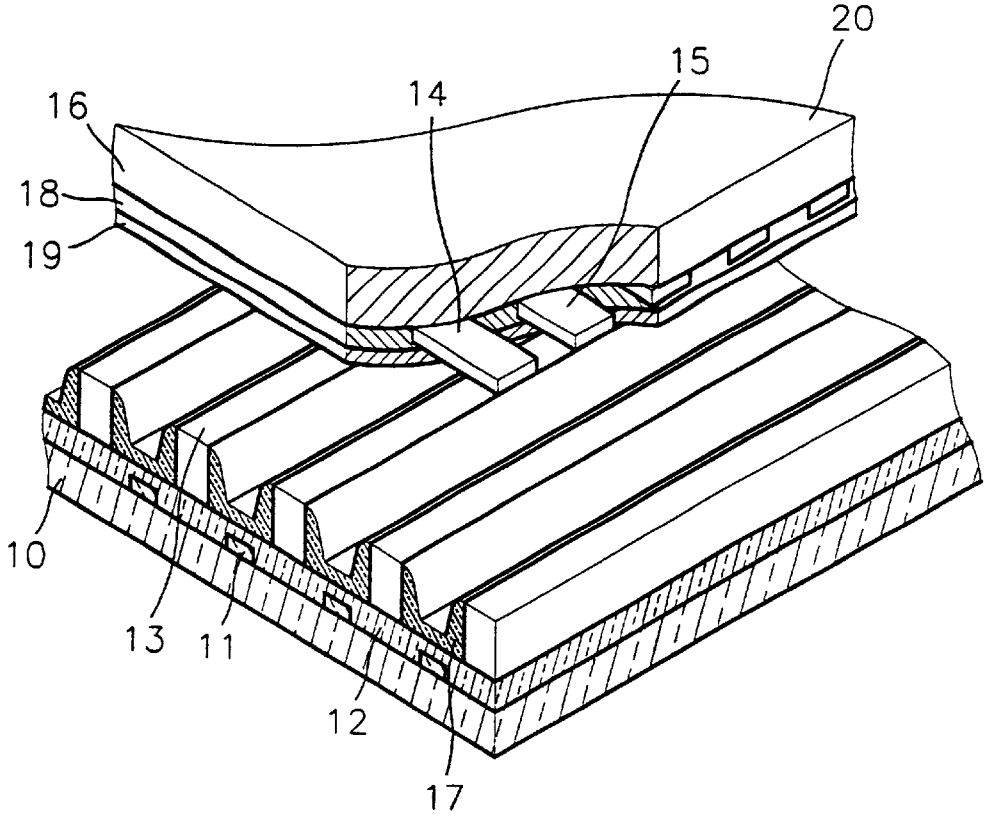
FIG.1 (PRIOR ART)
FIG. 1 is an exploded perspective view illustrating a conventional surface-discharge type plasma display device.
Figure 2:
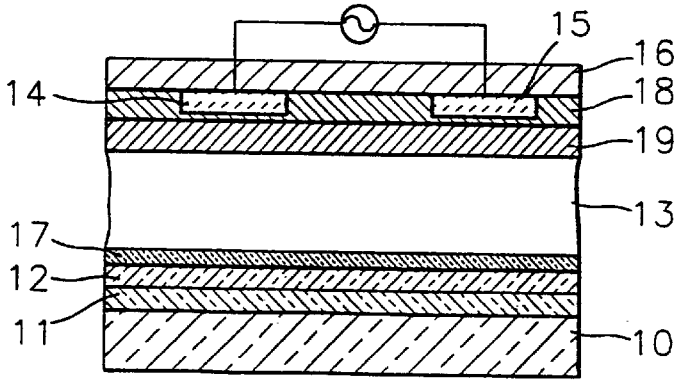
FIG.2 (PRIOR ART)
FIG. 2 is a sectional view of the surface-discharge type plasma display device shown in FIG. 1.
Figure 3:
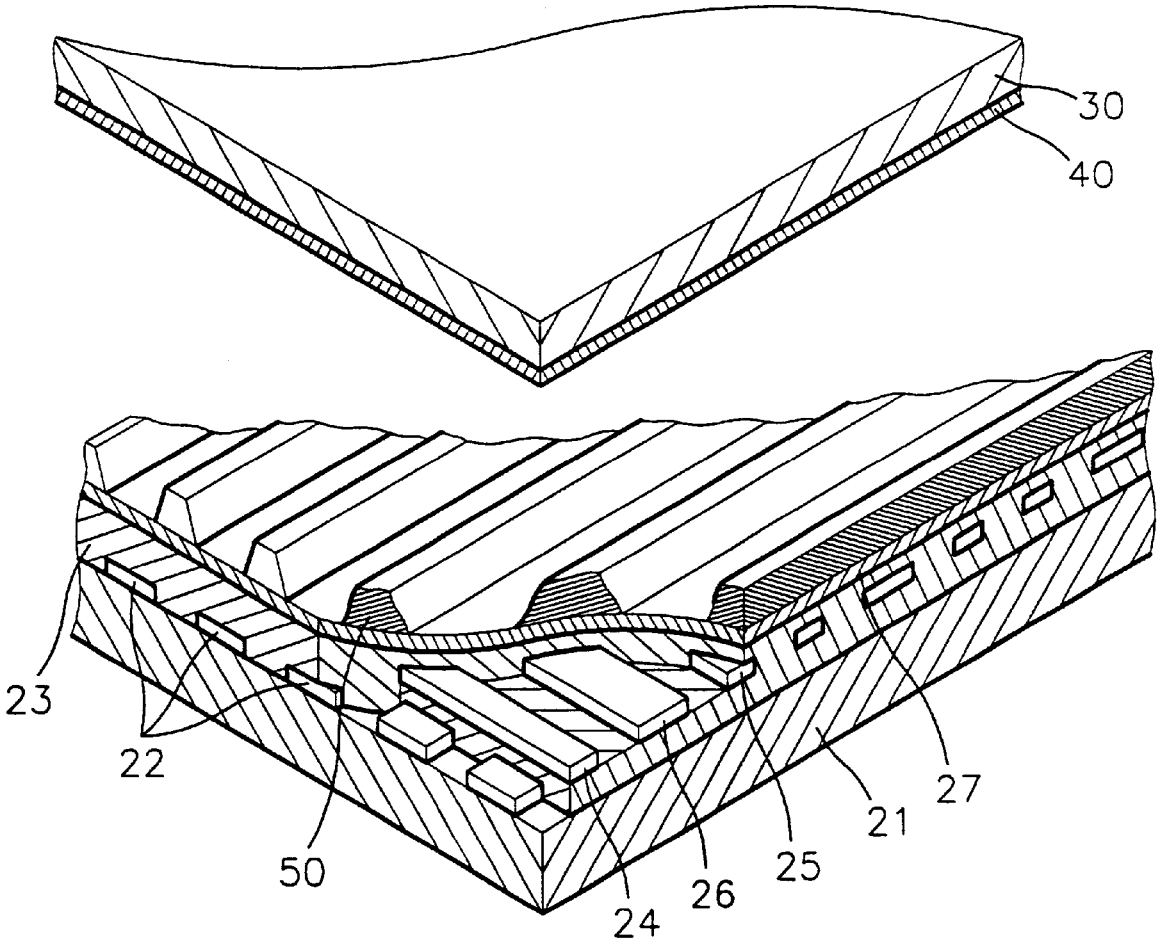
FIG. 3 is an exploded perspective view illustrating a plasma display device according to a preferred embodiment of the present invention.
Figure 4:
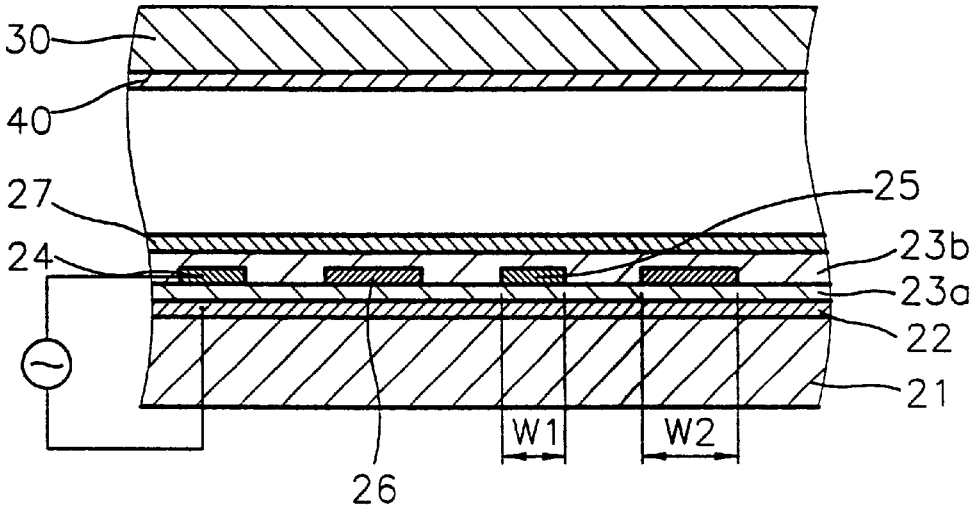
FIG. 4 is a sectional view of the plasma display device of FIG. 3.

FIGS. 3 and 4 show a plasma display device according to the present invention. Referring to the drawings, first electrodes 22 are formed in stripes on the upper surface of a rear substrate 21. A dielectric layer 23 is formed on the upper surface of the rear substrate 21, covering the first electrodes 22.

Second and third electrodes 24 and 25 are located in the dielectric layer 23 in a predetermined pattern, separated from the first electrodes 22 by a predetermined distance and perpendicular to the direction of the first electrodes 22. Auxiliary electrodes 26 are located in the dielectric layer 23 between the second and third electrodes 24 and 25. These auxiliary electrodes 26 are electrically floated.

A protective film 27 formed of MgO, for example, is formed on the upper surface of the dielectric layer 23. A partition 50 is located on the protective film 27 at predetermined intervals. Preferably, the partition 50 is parallel to and between the first electrodes 22. The formation of the partition 50 is not limited to the present embodiment above and any structure capable of defining a discharge space is possible.

A transparent front substrate 30 is coupled to the upper surface of the is partition 50, defining a discharge space which is filled with a discharge gas. Also, a fluorescent layer 40 is formed on the lower surface of the front substrate 30, within the discharge space.

The first, second, and third electrodes 22, 24, and 25 and the auxiliary electrode 26 can be of conductive ITO.

To reduce leakage current between the first and second electrodes 22 and 24, it is preferable that the width W2 of the auxiliary electrode 26 be larger than the width W1 of the second and third electrodes 24 and 25. This means that the surface area of the auxiliary electrode 26 per pixel unit is wider than that of the second electrode 24 or the third electrode 25.

Figure 5:
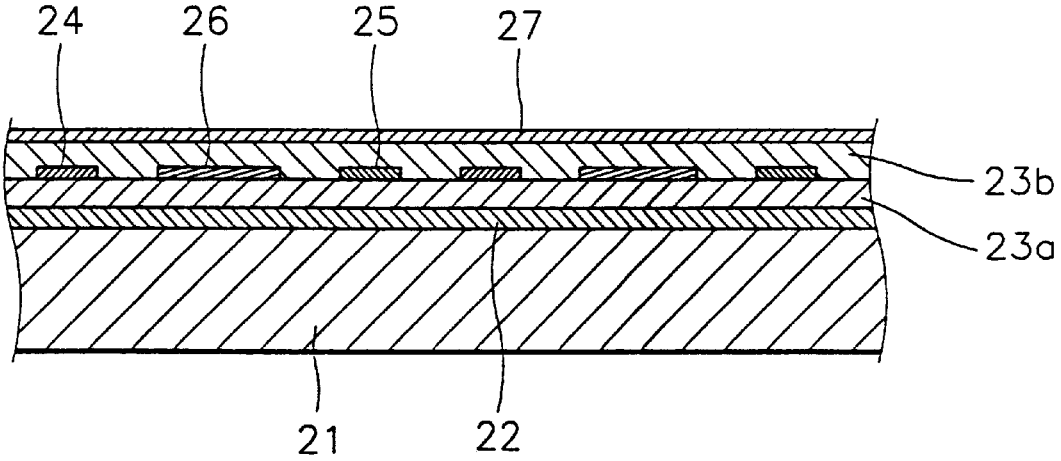
FIG. 5 is a sectional view of a plasma display device according to another preferred embodiment of the present invention.

Here, although the dielectric layer 23 is a single layer, as shown in FIG. 5, it may comprise a first dielectric layer 23*a* on which the first electrodes 22 are embedded, and a second dielectric layer 23*b*, on the upper surface of the first dielectric layer 23*a*, in which the second and third electrodes 24 and 25 and the auxiliary electrode 26 are embedded.

Figure 6:
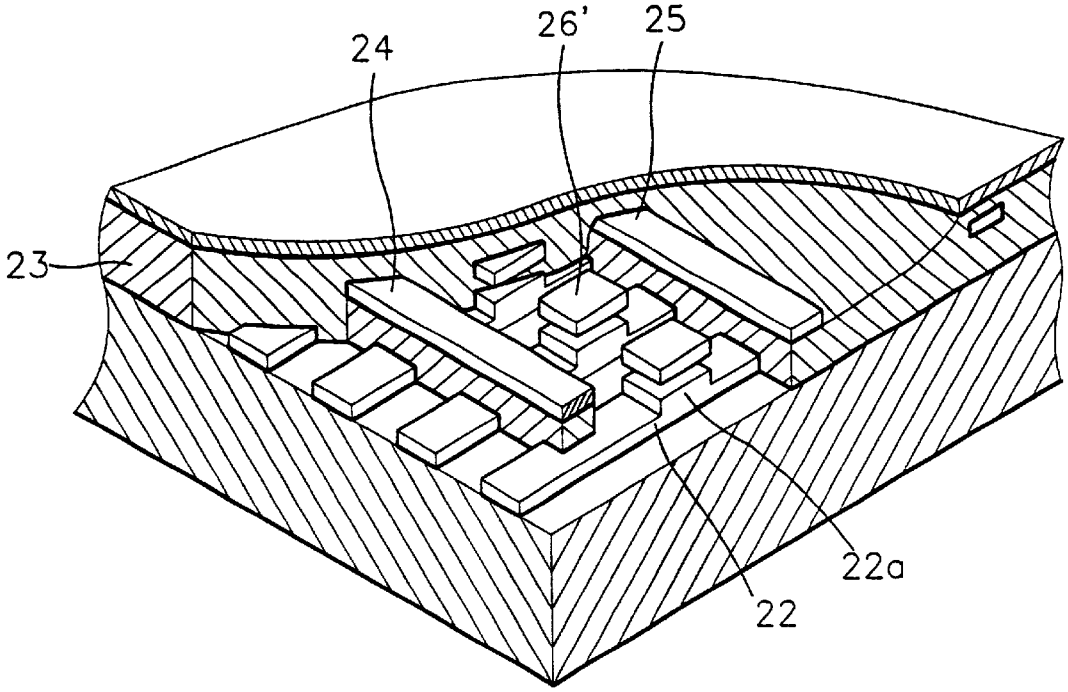
FIG. 6 is an exploded perspective view illustrating a plasma display device according to yet another preferred embodiment of the present invention.

Also, as shown in FIG. 6, auxiliary electrodes 26' can be discontinuous with a predetermined width and length.

Figure 7:
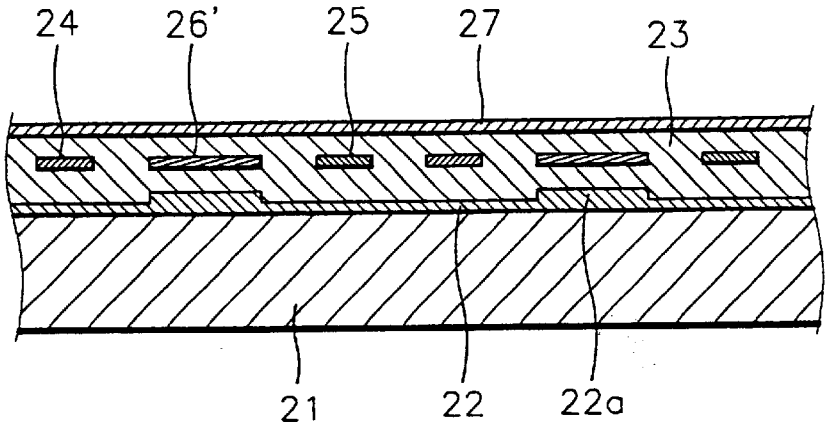
FIG. 7 is a sectional view of the plasma display device of FIG. 6.

Further, to increase the electrostatic capacitance of the auxiliary electrode 26', the thickness of the dielectric layer 23 between the first electrode 22 and the second electrode 24 or the first electrode 22 and the third electrode 25 is preferably larger than that of the dielectric layer 23 between the first electrode 22 and the auxiliary electrode 26. That is, to narrow the distance between the first electrode 22 and the auxiliary electrode 26', as shown in FIGS. 6 and 7, a protruding portion 22*a* of on the first electrode 22 is located at each position facing the auxiliary electrode 26'. Here, it is preferable that the size of the protruding portion 22*a* is the same as that of the auxiliary electrode 26.

The operation of the plasma display device having the above structure according to the present invention will be described with reference to FIGS. 3 and 4.

As a first AC voltage is applied to the first electrode 22 and the second electrode 24 of a selected pixel, a voltage difference is generated between the first electrode 22 and the second electrode 24, and the second electrode 24 and the auxiliary electrode 26. When the voltage applied reaches an insulation destroying voltage between the second electrode 24 and the auxiliary electrode 26, a discharge is generated along the surface of the protective film 27. Here, discharge current varies according to the areas of the first and second electrodes 22 and 24 and the auxiliary electrode 26 and the thickness and dielectric constant of the dielectric layer 23. Also, discharge voltage varies according to the thickness of the dielectric layer 23 between the second electrode 24 and the auxiliary electrode 26 and the first electrode 22 and the second electrode 24.

In a state in which charged particles cover the surface of the protective film 27 due to the discharge, when a predetermined voltage is applied to the second and third electrodes 24 and 25, a maintenance discharge is generated between the second and third electrodes 24 and 25. Here, since the electrically floated auxiliary electrode 26 is interposed between the second and third electrodes 24 and 25, the electrostatic capacitance between the second and third electrodes 24 and 25 becomes relatively greater so that a maintenance discharge can be generated at a low voltage.

Also, since the maintenance discharge is generated in a state in which the auxiliary electrode 26 is between the second and third electrodes 24 and 25, the length of discharge becomes relatively longer. The fluorescent layer 40 excited by ultraviolet light generated due to the maintenance discharge emits light.

Meanwhile, as shown in FIG. 6, when the distance between the auxiliary electrode 26' and the first electrode 22 is narrow because the protruding portion 22*a* is formed on the first electrode 22, the discharge voltage can be lowered. That is, since the surface area of the auxiliary electrode 26' is less than that of the second electrode 24 and since the thickness of the dielectric layer 23 between the first electrode 22 and the auxiliary electrode 26' is narrower than that of the dielectric layer 23 between the first electrode 22 and the second electrode 24, the capacitance between the first electrode 22 and the auxiliary electrode 26' becomes greater than that between the first electrode 22 and the second electrode 24 so that a surface discharge can be effectively generated.

As described above, in a surface emission type plasma display device according to the present invention, since the second and third electrodes are located on the rear substrate to generate a maintenance discharge, not on the front substrate, optical transmissivity of the front substrate can be improved. Also, since an auxiliary electrode is located between the second and third electrode to thus widen the distance between the second and third electrodes, the length of discharge can be relatively longer so that the intensity of ultraviolet light exciting the fluorescent layer can be increased.

It is noted that the present invention is not limited to the preferred embodiment described above, and it is apparent that variations and modifications by those skilled in the art can be effected within the spirit and scope of the present invention defined in the appended claims.

What is claimed is:

1. A plasma display device comprising:

a rear substrate;

a plurality of first electrodes on an upper surface of said rear substrate in a pattern;

a plurality of second electrodes and a plurality of third electrodes spaced from said first electrodes by a distance, parallel to each other, and perpendicular to said first electrodes;

a plurality of auxiliary electrodes parallel to each other, each auxiliary electrode being located between one of said second electrodes and one of said third electrodes and floating electrically, the electrodes being arranged in repeating groups, each group including, serially arranged, one of said second electrodes, one of said auxiliary electrodes, and one of said third electrodes, the third electrode of one group being adjacent the second electrode of an adjacent group;

a dielectric layer on the upper surface of said rear substrate covering said first electrodes, said second electrodes, and said third electrodes, said auxiliary electrodes being embedded in and electrically insulated from one another by said dielectric layer; and a front substrate supported by and separated from said rear substrate by said dielectric layer and defining a discharge space.

2. The plasma display device as claimed in claim 1, wherein said dielectric layer comprises:

a first dielectric layer in which said first electrodes are embedded; and a second dielectric layer in which said second electrodes, said third electrodes, and said auxiliary electrodes are embedded.

3. The plasma display device as claimed in claim 1 wherein each of said auxiliary electrodes includes a plurality of discontinuous portions, each portion having a width and a length.

4. A plasma display device comprising;

a rear substrate;

first electrodes on an upper surface of said rear substrate in a pattern;

second and third electrodes spaced from said first electrodes by a distance, parallel to each other, and perpendicular to said first electrodes;

auxiliary electrodes parallel to each other, each auxiliary electrode being located between a pair of said second and third electrodes and floating electrically;

a dielectric layer on the upper surface of said rear substrate covering said first electrodes, said second electrodes, and said third electrodes, wherein said auxiliary electrodes are embedded in and electrically insulated from one another by said dielectric layer, and said dielectric layer between said first electrode and said second electrode has a thickness larger than the thickness of said dielectric layer between said first electrode and said auxiliary electrode.

5. The plasma display device as claimed in claim 1, including a protruding portion on each said first electrodes opposite said auxiliary electrode.

6. The plasma display device as claimed in claim 1, wherein said second, third, and auxiliary electrodes are coplanar and lie in a plane different from said first electrodes.

7. A plasma display device comprising:

a rear substrate;

a plurality of first electrodes on said rear substrate in strips, parallel to each other;

a plurality of second electrodes and a plurality of third electrodes spaced from said first electrodes by a distance, parallel to each other, and perpendicular to said first electrodes;

a plurality of auxiliary electrodes parallel to each other, each auxiliary electrode being located between one of said second electrodes and one of third electrodes and floating electrically, the electrodes being arranged in repeating groups, each group including, serially arranged, one of said second electrodes, one of said auxiliary electrodes, and one of said third electrodes, the third electrode of one group being adjacent the second electrode of an adjacent group;

a dielectric layer on the upper surface of said rear substrate covering said first electrodes, said second electrodes, and said third electrodes, said auxiliary electrodes being embedded in and electrically insulated from one another by said dielectric layer;

partitions on the upper surface of said dielectric layer and between neighboring first electrodes, parallel to said first electrodes;

a transparent front substrate said rear substrate and defining a discharge space along with said partitions; and a fluorescent layer on a lower surface of said front substrate inside the discharge space.

8. The plasma display device as claimed in claim 7, wherein said second, third, and auxiliary electrodes are coplanar and lie in a plane different from said first electrodes.

* * * * *